US009476328B2

(12) United States Patent
Print

(10) Patent No.: US 9,476,328 B2
(45) Date of Patent: Oct. 25, 2016

(54) DEVICE FOR EFFECTING AN AXIAL SHIFT OF A ROTARY SHAFT FOR USE IN A VARIABLE CAMSHAFT DRIVE MECHANISM

(71) Applicant: JAGUAR LAND ROVER LIMITED, Warwickshire (GB)

(72) Inventor: Iain Print, Whitley (GB)

(73) Assignee: Jaguar Land Rover Limited, Whitley, Coventry (GB)

( * ) Notice: Subject to any disclaimer, the term of this patent is extended or adjusted under 35 U.S.C. 154(b) by 0 days.

(21) Appl. No.: 14/764,257

(22) PCT Filed: Jan. 27, 2014

(86) PCT No.: PCT/EP2014/051467

§ 371 (c)(1),
(2) Date: Jul. 29, 2015

(87) PCT Pub. No.: WO2014/118104

PCT Pub. Date: Aug. 7, 2014

(65) Prior Publication Data

US 2015/0369089 A1 Dec. 24, 2015

(30) Foreign Application Priority Data

Jan. 31, 2013 (GB) ..... 1301719.9

(51) Int. Cl.
*F01L 1/34* (2006.01)
*F01L 1/344* (2006.01)
(Continued)

(52) U.S. Cl.
CPC ..... *F01L 1/344* (2013.01); *F01L 1/047* (2013.01); *F02B 57/00* (2013.01); *F01L 2820/035* (2013.01)

(58) Field of Classification Search
CPC .... F01L 1/047; F01L 1/344; F01L 2820/035
USPC ..... 123/90.16, 90.18
See application file for complete search history.

(56) References Cited

U.S. PATENT DOCUMENTS 3,243,024 A 3/1966 Schwab
8,978,605 B2 * 3/2015 Friedrichs ..... F01L 1/047 123/90.16
2010/0025138 A1 2/2010 Ruscak

FOREIGN PATENT DOCUMENTS

DE 2950656 A1 6/1981
EP 2161434 A1 3/2010
(Continued)

OTHER PUBLICATIONS

Combined Search and Examination Report under Sections 17 and 18(3) for Application No. GB130719.9 dated Jun. 25, 2013.
(Continued)

*Primary Examiner* — Ching Chang
(74) *Attorney, Agent, or Firm* — Carlson, Gaskey & Olds

(57) ABSTRACT

A device for effecting an axial shift of a rotary shaft such as the camshaft of a vehicle comprising a first component having a shaft and a head, a second component having a first end and second end and a bore extending longitudinally there through, the shaft of the first component being inserted into the bore of the second component, a detent couples the first component to the second component such that rotation of the second component causes the first component to rotate wherein the first end of the second component is counter-sunk so as to define inclined ramps in walls of the second component and one or more rollers are disposed between the head of the first component and the first end of the second component in rolling contact with the inclined ramps, wherein as the second component is rotated about a longitudinal axis the rollers move along the inclined ramps and act upon the first component to move it axially with respect to the second component which may be arranged to rotate the first component with respect to the second component. In this way the timing of the valves of a combustion engine can be varied with rotational speed of the crankshaft of the engine.

20 Claims, 14 Drawing Sheets

(51) Int. Cl.

| | |
|---|---|
| ***F01L 1/047*** | (2006.01) |
| ***F02B 57/00*** | (2006.01) |

(56) References Cited

FOREIGN PATENT DOCUMENTS

| | | | |
|---|---|---|---|
| GB | 375315 | | 6/1932 |
| GB | 970161 | | 9/1964 |
| GB | 1011700 | | 12/1965 |
| GB | 1210347 | | 10/1970 |
| GB | 1595837 | | 8/1981 |
| GB | 2263152 | A | 7/1993 |
| JP | S60113006 | | 6/1985 |
| JP | S60147512 | A | 8/1985 |
| JP | H0526017 | A | 2/1993 |
| JP | H05296057 | A | 11/1993 |

OTHER PUBLICATIONS

International Searching Report and Written Opinion of the International Search Authority for International application No. PCT/EP2014/051467 dated May 16, 2014.

* cited by examiner 44
52
62
49
51
47
55
62
45

47
55
62
40
62
51
44
45
52
49

40

DEVICE FOR EFFECTING AN AXIAL SHIFT OF A ROTARY SHAFT FOR USE IN A VARIABLE CAMSHAFT DRIVE MECHANISM

TECHNICAL FIELD

The present invention relates to a device for effecting an axial shift of a rotary shaft, to a variable drive mechanism for a camshaft and a method of varying the drive of a camshaft. In particular, but not exclusively, the invention relates to a mechanical system for automatically adjusting the timing of valves in a combustion engine. Aspects of the invention relate to a device, to a variable drive mechanism, to an engine, to a vehicle and to a method.

BACKGROUND

In internal combustion engines it is known to provide a plurality of cylinders and pistons for rotating a drive shaft via a crank shaft. In vehicle applications the crank shaft is coupled to the drive train, which may include a clutch, gearbox, prop shaft (for rear-wheel drive), differential, and final drive shafts. The cylinder comprises inlet and outlet apertures; these inlet and outlet apertures comprise valves for controlling ingress of a fuel/air mixture and egress of exhaust gases. The valves are controlled by one or more camshafts which determine the timing of the opening and closing of the valves with respect to the position or stroke of the piston in the respective cylinder.

It is desirable to adjust several parameters relating to the operation of the valves depending upon the load or requirements placed upon the engine. Such requirements may be, by way of non-limiting example: to increase engine power; and to reduce fuel consumption or engine emissions. Examples of the operational parameters that it is desirable to adjust include:

i. the timing of the valve opening and closing with respect to the piston stroke;
ii. the timing of the inlet valve opening/closing with respect to that of the outlet (exhaust) valve;
iii. the duration of time for which the valves are open and/or closed;
iv. the degree or extent to which the valve is opened (lifted).

The present invention seeks to provide an improvement in the field of variable camshaft drive mechanisms, which has particular application for vehicles. The invention may be utilised in applications other than for vehicles; for example it is foreseen that the invention may have application in other areas where is it desirable to effect an axial shift of a rotary shaft for example in compressors or pumps.

SUMMARY OF THE INVENTION

Aspects of the invention provide a device, a variable drive mechanism, an engine, a vehicle and a method as claimed in the appended claims.

According to an aspect of the invention for which protection is sought, there is provided a device for effecting an axial shift of a rotary shaft comprising:

a first component having a shaft and a head;

a second component having a first end and a second end and a bore extending longitudinally therethrough to define a tubular structure defined by a tubular wall, the first end of the second component being countersunk so as to define a rolling surface arranged such that the thickness of the tubular wall decreases towards the first end;

the shaft of the first component being inserted into the bore of the second component; and the device comprising:

a detent for coupling the first component to the second component such that rotation of the second component causes the first component to rotate; and one or more actuators disposed in between the head of the first component and the first end of the second component in rolling contact with the rolling surface;

the device being configured such that as the second component is rotated about a longitudinal axis the actuators move over the rolling surface so as to act upon the first component to move it axially with respect to the second component.

Advantageously, the device may employ centrifugal force to effect an axial movement of the first component with respect to the second component.

According to one aspect of the invention for which protection is sought, there is provided a device for effecting an axial shift of a rotary shaft comprising:

a first component having a shaft and a head;

a second component having a first end and a second end and a bore extending longitudinally therethrough, the first end of the second component being countersunk so as to define inclined ramps in walls of the second component;

the shaft of the first component being inserted into the bore of the second component; and the device comprising:

a detent for coupling the first component to the second component such that rotation of the second component causes the first component to rotate; and one or more rollers disposed in between the head of the first component and the first end of the second component in rolling contact with the inclined ramps;

the device being configured such that as the second component is rotated about a longitudinal axis the rollers move along the inclined ramps and act upon the first component to move it axially with respect to the second component.

Optionally, the detent comprises a groove and a follower seated therein, the groove arranged to effect a rotation of the first component with respect to the second component as the first component is moved axially with respect to the second component. Optionally the follower is a ball bearing.

In some embodiments, the device comprises a resilient biasing device biased against the first component to resist the axial movement of the first component with respect to the second component. In this way the device can be controlled and switched on or off as required.

Optionally, the resilience of the resilient biasing device is dependent upon temperature.

Further optionally, the resilient biasing device comprises a bi-metallic spring disposed in thermal contact with a reservoir of liquid and wherein, in response to a change in the temperature of the liquid in the reservoir the resilience of the bi-metallic spring changes and thereby the device can be de-activated by the resiliently biasing device at certain temperatures.

Optionally, the inclined ramps comprise one or more tracks defined in and extending radially across the walls of the second component, each track being configured to receive a portion of a roller to restrict movement of the roller to a radial direction only.

The first component may comprise a spline for coupling to a camshaft to effect rotation thereof.

According to another aspect of the invention for which protection is sought, there is provided a variable drive mechanism for a camshaft comprising:

a first component having a shaft and a head, the shaft comprising a spline for coupling the first component to a camshaft;

a second component having a first end and a second end and a bore extending longitudinally therethrough for receiving the shaft of the first component, the second component comprising a sprocket for being coupled to a crankshaft to effect rotation of the second component;

a detent for coupling the first component to the second component such that rotation of the second component causes the first component to rotate;

one or more actuators disposed in between the head of the first component and the first end of the second component;

wherein in response to rotation of the second component, about a longitudinal axis, a centrifugal or centripetal force causes the actuators to act upon the head of the first component to move it axially with respect to the second component.

Optionally, the detent comprises a groove arranged to effect a rotation of the first component, with respect to the second component, as the first component is moved axially with respect to the second component.

In some embodiments, the first end of the second component is countersunk so as to define inclined ramps in walls of the second component and the actuators comprise one or more rollers disposed in between the head of the first component and the first end of the second component in rolling contact with the inclined ramps.

According to a further aspect of the invention for which protection is sought, there is provided an engine for a vehicle comprising:

one or more cylinders;

the or each cylinder comprising a piston slideably mounted therein;

the or each piston being coupled to a crankshaft by a connecting rod;

a first sprocket mounted upon the crankshaft;

the or each cylinder comprising one or more openings;

the or each opening comprising a valve for closing the opening;

a camshaft comprising one or more cams for actuating a respective valve; and a variable drive mechanism coupled to the camshaft;

the variable drive mechanism comprising:

a first component having a shaft and a head, the shaft comprising a spline coupling the first component to the camshaft;

a second component having a first end and a second end and a bore extending longitudinally therethrough in which the shaft of the first component is mounted, the second component comprising a second sprocket coupled to the first sprocket such that rotation of the crankshaft effects rotation of the second component;

a detent coupling the first component to the second component such that rotation of the second component causes the first component to rotate;

one or more actuators disposed in between the head of the first component and the first end of the second component;

the engine being configured such that, in response to rotation of the second component, about a longitudinal axis, a centrifugal or centripetal force causes the actuators to act upon the head of the first component to move it axially with respect to the second component whereby changing a control parameter of the operation of the or each valve.

Optionally, the detent comprises a groove arranged to effect a rotation of the first component with respect to the second component, as the first component is moved axially with respect to the second component, so as to advance or retard the opening or closing of the or each valve with respect to a predefined position of a respective piston within its respective cylinder.

In some embodiments, each cylinder comprises at least two openings each having a valve, wherein at least one valve is an inlet valve for allowing insertion of charge into the cylinder, and at least one valve is an outlet valve for allowing egress of exhaust gases, the engine comprising a first camshaft having at least one cam for actuating a respective one of the at least one inlet valves and a second cam shaft having at least one cam for actuating a respective one of the at least one outlet valves, each camshaft comprising a variable drive mechanism coupled thereto, wherein each variable drive mechanism can advance or retard the opening or closing of the or each of the respective valves to which it is coupled with respect to a predefined position of a respective piston within its respective cylinder. In this way the period of time when both the inlet valves and the outlet valves are open or closed simultaneously can be controlled dependent upon rotational speed of the crankshaft.

Optionally, at least one valve mounted upon the camshaft comprises a profile which changes in an axial direction such that an axial movement of the camshaft effects a change in the cam profile with a change in the rotational speed of the crankshaft.

According to yet another aspect of the invention for which protection is sought, there is provided a method of controlling the operation of one or more valves of an engine, the method comprising:

providing an engine having a variable drive mechanism having at least one actuator, the variable drive mechanism being coupled to at least one camshaft;

rotating a crankshaft of the engine so as to rotationally drive the variable drive mechanism; and thereby rotating the camshaft; and moving the camshaft in an axial direction as a result of a centrifugal force or centripetal force acting upon the at least one actuator, thereby changing an operational parameter of the one or more valves of the engine.

According to yet a further aspect of the invention for which protection is sought, there is provided a vehicle comprising the device, the variable drive mechanism, or an engine capable of carrying out the method as described in the foregoing paragraphs.

Within the scope of this application it is expressly intended that the various aspects, embodiments, examples and alternatives set out in the preceding paragraphs, in the claims and/or in the following description and drawings, may be taken independently or in any combination thereof. For example, features described in connection with one embodiment are applicable to all embodiments, unless such features are incompatible.

BRIEF DESCRIPTION OF THE DRAWINGS

One or more embodiments of the invention will now be described, by way of example only, with reference to the accompanying drawings, in which.

DETAILED DESCRIPTION OF EMBODIMENTS

Detailed descriptions of specific embodiments of the device for effecting an axial shift of a rotary shaft, the variable drive mechanism for a camshaft, and the method of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the device for effecting an axial shift of a rotary shaft, the variable drive mechanism for a camshaft, and the method described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
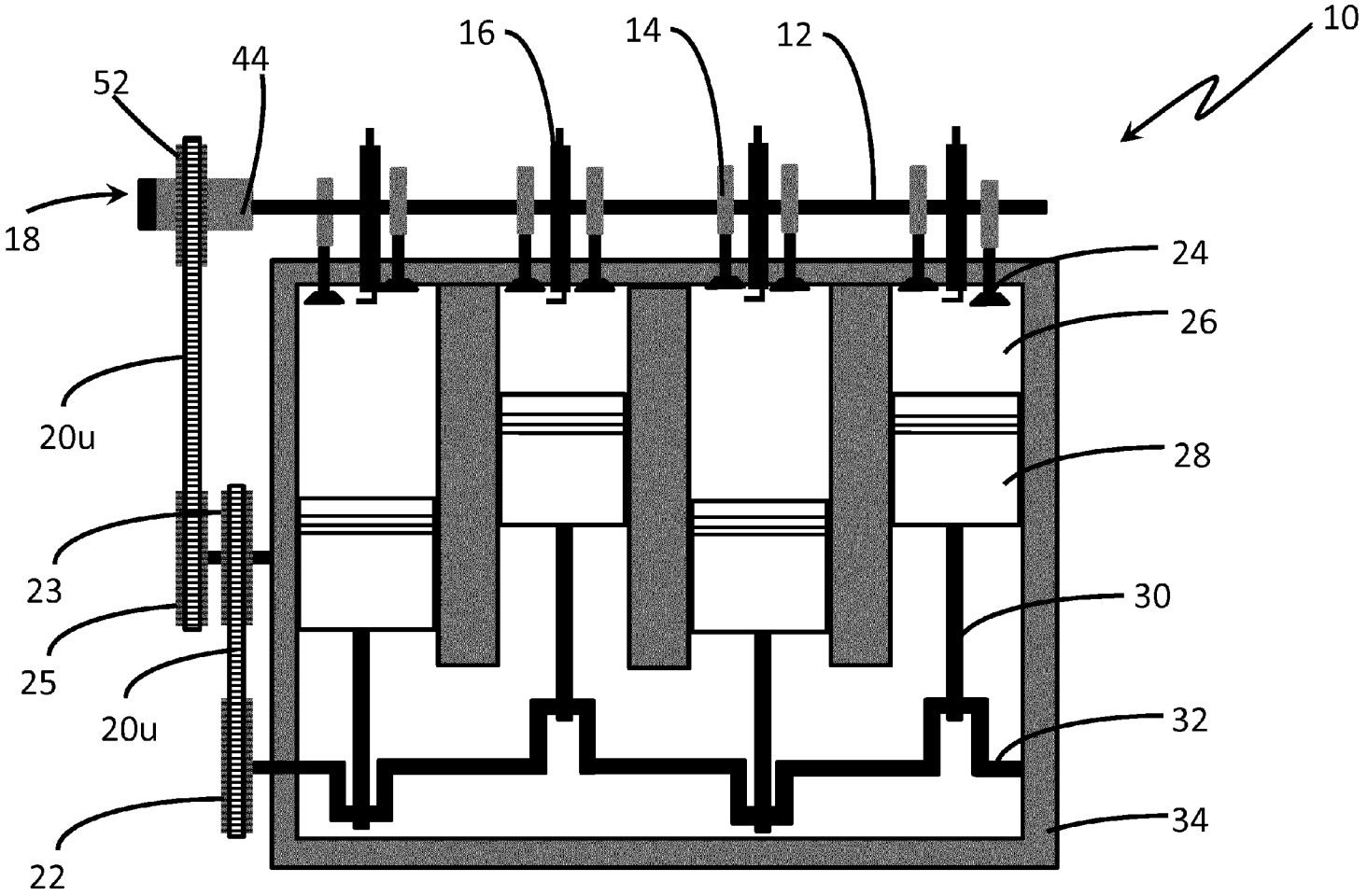
FIG. 1 is a schematic view of an internal combustion engine employing a variable camshaft drive mechanism according to an embodiment of the invention.

Referring to FIG. 1, there is shown a schematic view of an internal combustion engine 10. The internal combustion engine 10 comprises four cylinders 26, in each of which a piston 28 is located. The cylinders 26 are defined by a housing or engine block 34. The pistons 28 are slideably mounted within the cylinders 26. The pistons 28 are coupled to a crank shaft 32 by connecting rods 30. The crank shaft 32 is arranged so as to convert linear motion of the pistons 28 into rotary motion. It is envisaged that the crank shaft 32 will be coupled to a drive train (not shown) to provide rotary drive to road wheels (not shown) of a vehicle (not shown). The cylinders each comprise inlet and outlet apertures, these inlet and outlet apertures comprise valves 24 for controlling ingress of fuel/air mixture and egress of exhaust gases. The valves 24 are controlled by one or more camshafts 12 which determine the timing of the opening and closing of the valves 24 with respect to the position or stroke of the piston 28 in the respective cylinder 26. The camshaft 12 comprises a plurality of cams 14 mounted thereon; a cam 14 is provided for each valve 24. The illustrated embodiment includes two valves 24 for each cylinder 26: one inlet valve; and one outlet valve. In an alternative embodiment more valves per cylinder may be provided for example, but not limited to, four valves per cylinder: two inlet and two outlet valves. In the illustrated embodiment, a single overhead camshaft 12 is provided, and therefore the inlet and outlet valves 24 are controlled by a single camshaft 12. The camshaft 12 may include a rocker arm (not shown) and a push rod (not shown).

In other embodiments, it is envisaged that two or more camshafts may be provided; for example, a first camshaft may be provided to actuate the inlet valves and a second camshaft may be provided to actuate the outlet valves.

It some embodiments the camshaft may be of a one-piece solid construction; in other embodiments the camshaft may be an assembled camshaft built up from multiple components.

The illustrated embodiment employs a first cam lobe 14 for a first, inlet, valve 24 and a second cam lobe 14 for a second, outlet, valve 24 for each cylinder 26, in other embodiments it is envisaged that a single cam lobe may actuate both the inlet and outlet valves.

The shape and arrangement of the cams 14 control:

i. the timing of the valve 24 opening and closing with respect to the piston 28 stroke;
ii. the timing of the inlet valve 24 opening/closing with respect to that of the outlet (exhaust) valve 24;
iii. the duration of time for which the valves 24 are open and/or closed;
iv. the degree or extent to which the valve is opened (lifted).

Figures 2A, 2B, 2C:
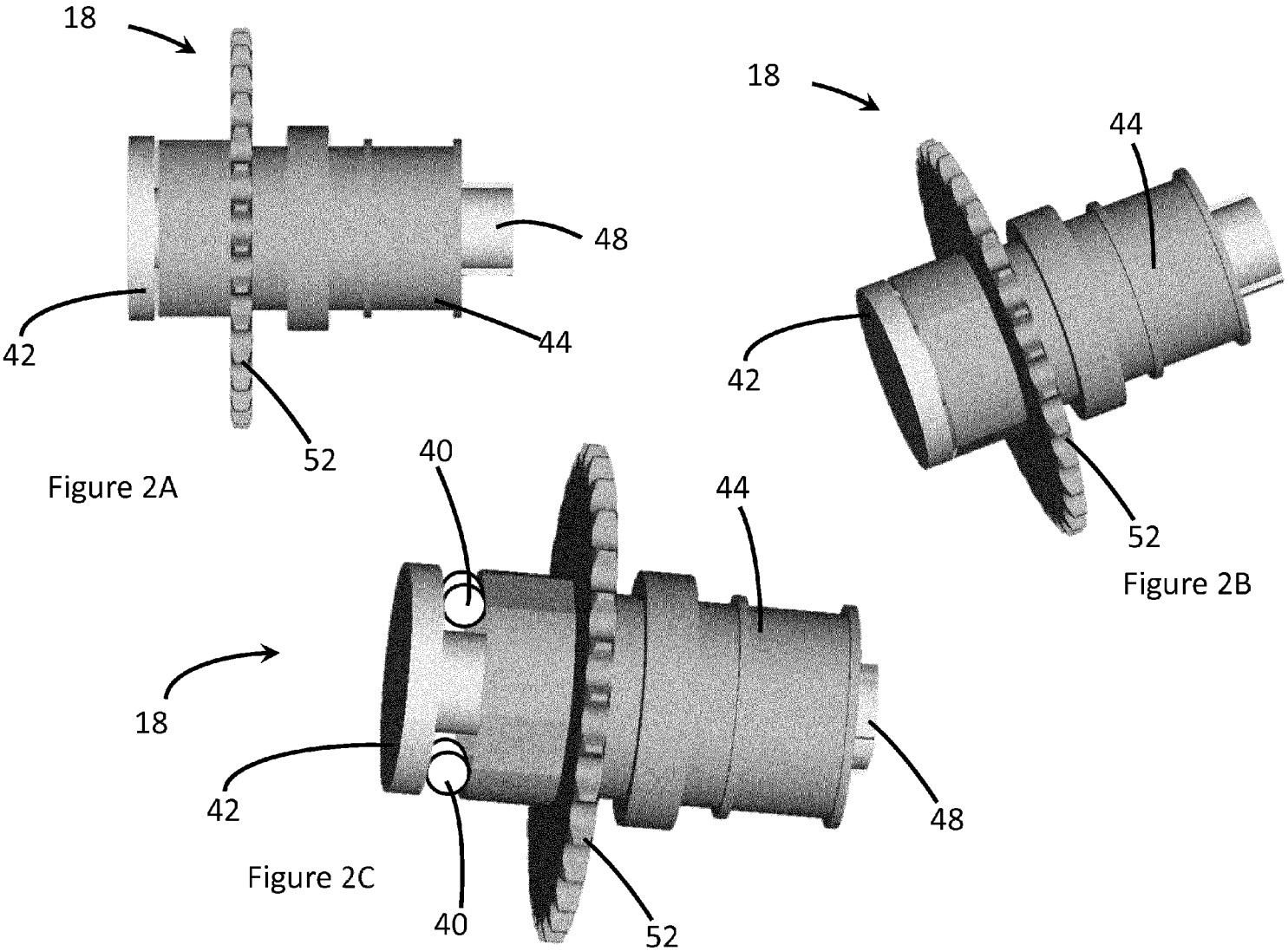
FIG. 2A is a side view of a variable camshaft drive mechanism according to an embodiment of the invention.
FIGS. 2B and 2C are perspective views of the variable camshaft drive mechanism of FIG. 2A.
Figure 3A:
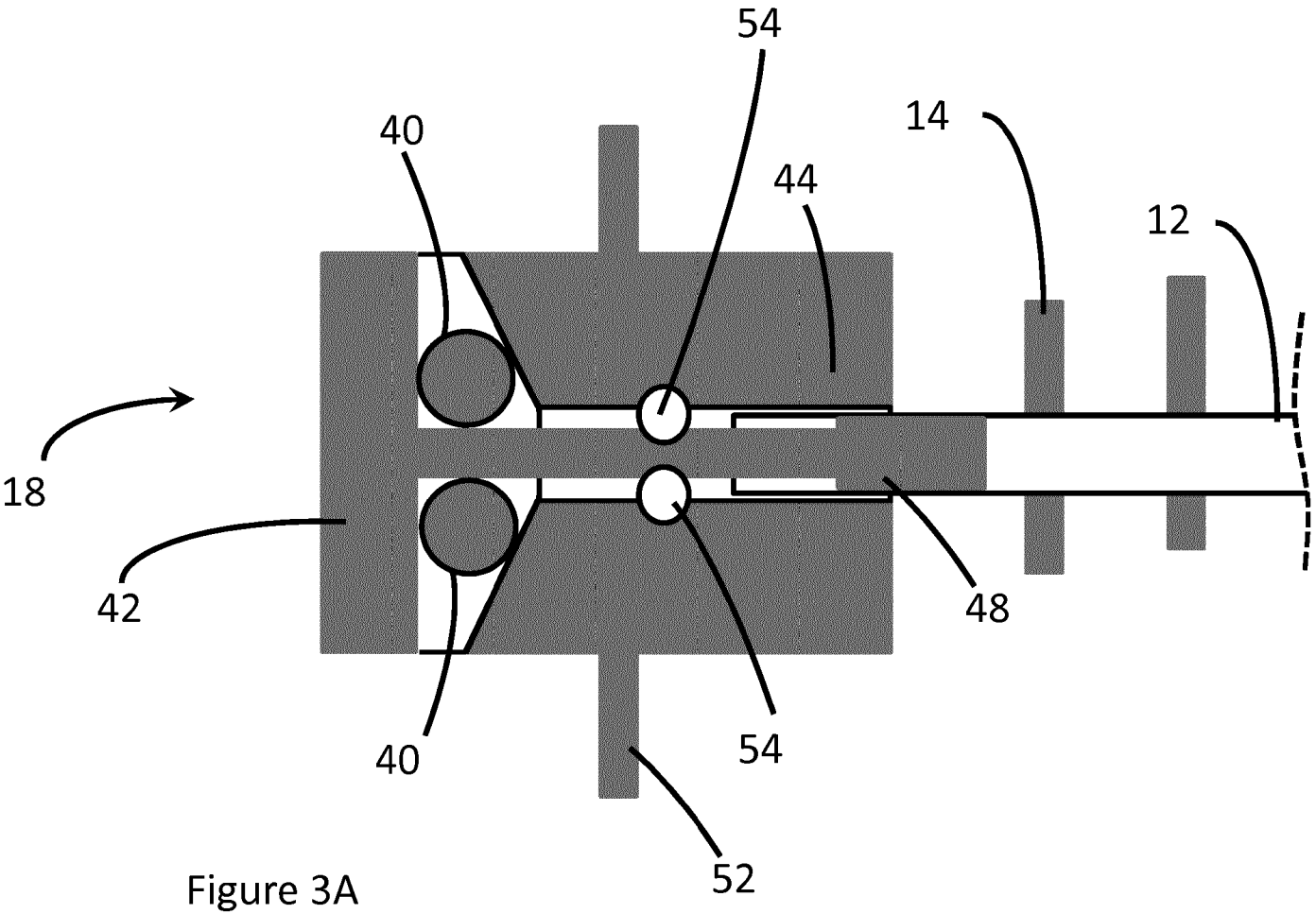
FIG. 3A is a cross-sectional view of the variable camshaft drive mechanism and a portion of the camshaft of FIG. 1 shown in a first condition.
Figure 3B:
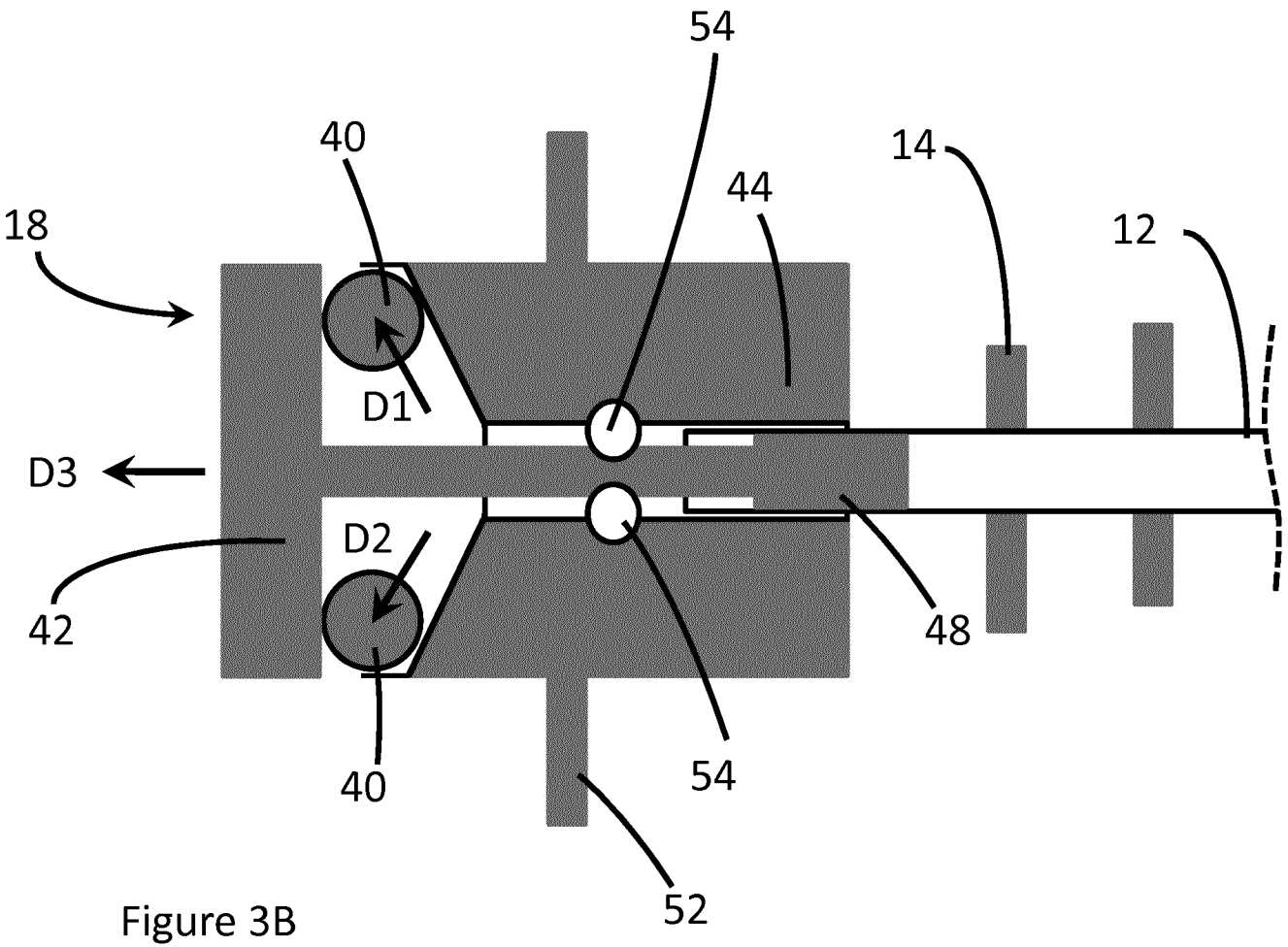
FIG. 3B is a cross-sectional view of the variable camshaft drive mechanism and a portion of the camshaft of FIG. 1 shown in a second condition.
Figure 4B:
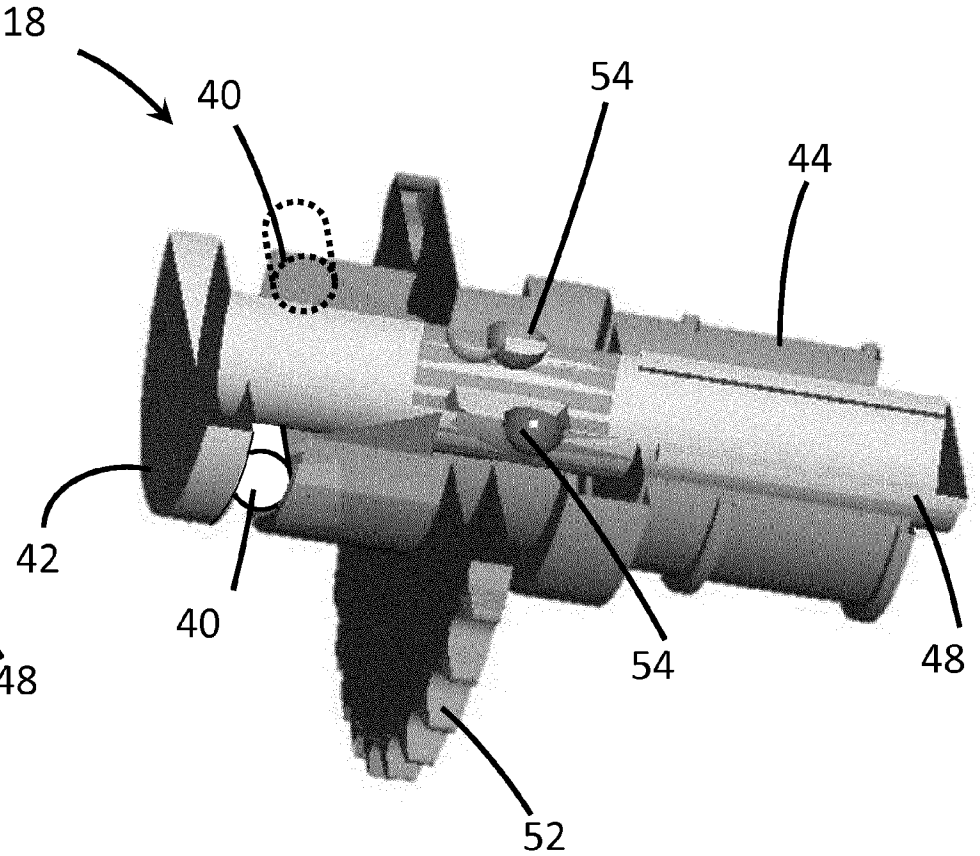
FIG. 4B is a cut away perspective view of the variable camshaft drive mechanism of FIG. 2C.
Figure 4A:
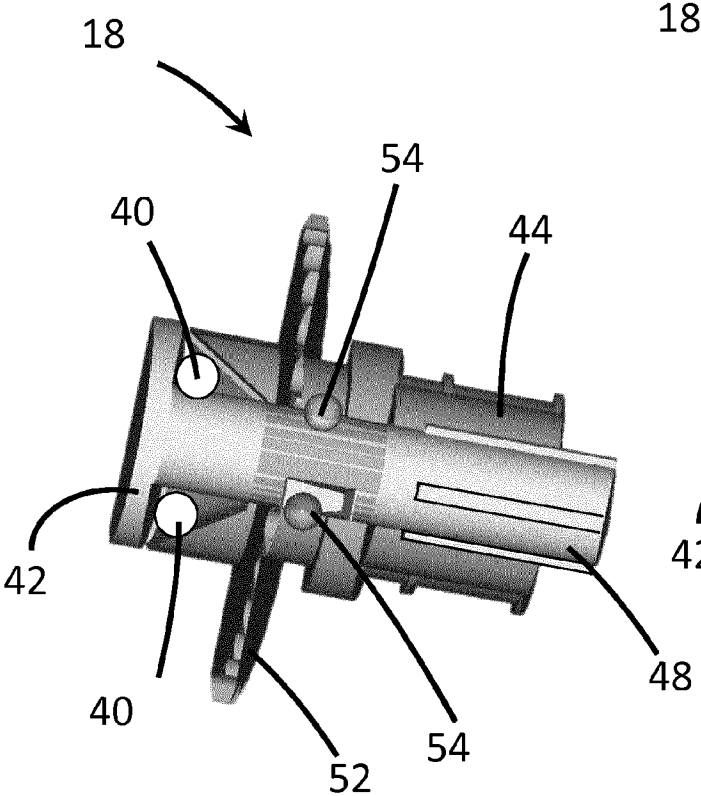
FIG. 4A is a cross-sectional view of the variable camshaft drive mechanism of FIG. 2C.
Figure 6B:
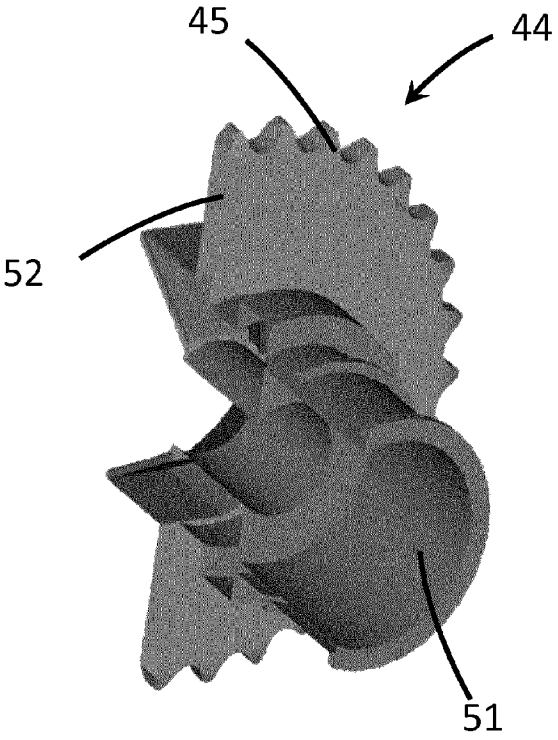
FIG. 6B is a cut away perspective view of the second component of FIG. 6A.
Figure 6A:
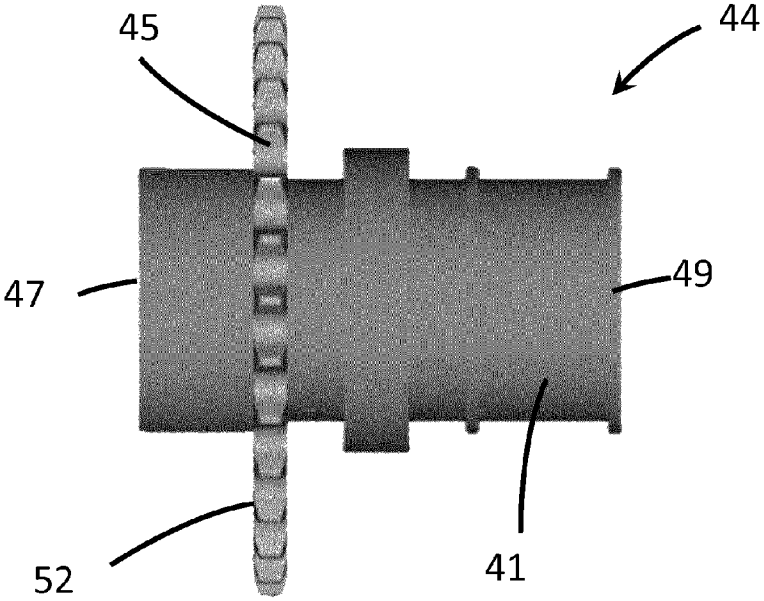
FIG. 6A is a side view of a second component forming the variable camshaft drive mechanism according to an embodiment of the invention.
Figure 6D:
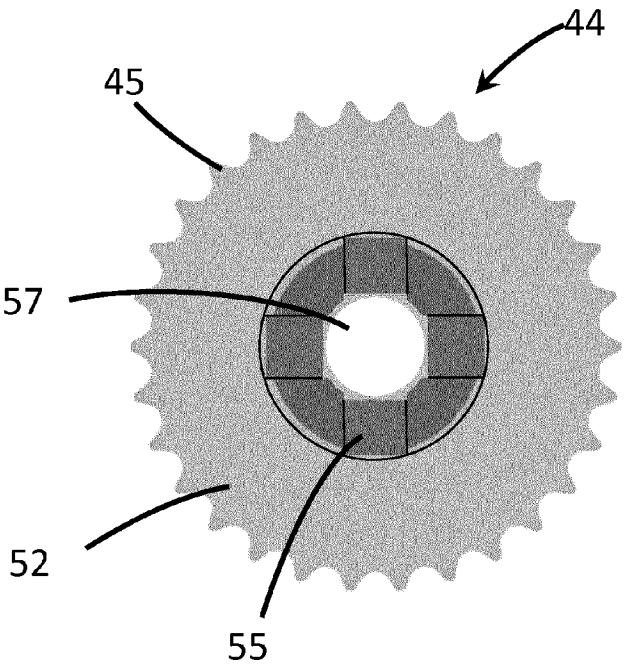
FIG. 6D is an end view of the second component of FIG. 6A.
Figure 6C:
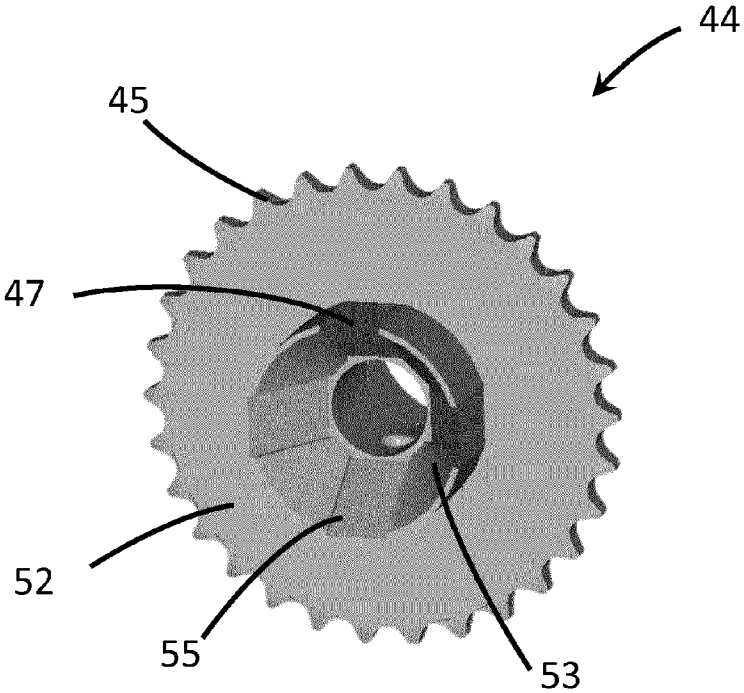
FIG. 6C is a perspective view from a first end of the second component of FIG. 6A.

The engine 10 comprises a first gear wheel or sprocket 22 mounted to an end of the crank shaft 32. A second sprocket 52, as shown in FIG. 2A, is coupled to the first sprocket 22 by a timing belt or chain 20. The second sprocket 52 comprises teeth 45 for engaging with the timing belt or chain 20 (see FIG. 6A). In alternative embodiments the first sprocket 22 may be coupled to the second sprocket 52 by a pair of timing belts via a pair of intermediate gear wheels; wherein the pair of intermediate gear wheels are mounted upon a common shaft such that rotation of one of the pair of intermediate gear wheels effects rotation of the other of the pair of intermediate gear wheels. A first one of the timing belts being mounted upon the first sprocket 22 and a first one of the intermediate gear wheels, and a second one of the timing belts being mounted upon a second one of the intermediate gear wheels and the second sprocket 52. In other embodiments the timing belts or chains may be omitted, alternative connection means may be employed to connect the crank shaft 32 to the camshaft 12, for example, but not limited to, a gear system or shaft system employing gears such as but not limited to helical or bevel gears. The first sprocket and second sprocket may engage with one another directly or via one or more intermediate gears, in yet other embodiments a shaft may be employed to couple the crankshaft 32 to the camshaft 12. In other embodiments, The second sprocket 52 forms part of a variable drive camshaft mechanism 18 which includes a first component 42 moveably mounted within a second component 44 (see FIGS. 2A to 2C). The first component 42 comprises a shaft 48 which extends through a channel or bore 51 provided in the second component 44 as shown in FIGS. 6A and 6B. Second sprocket 52 is fixedly mounted to a sleeve 41 (see FIG. 6A) of the second component 44 such that rotation of the second sprocket 52 causes rotation of the sleeve 41 of the second component 44.

In the illustrated embodiment of FIG. 1, the engine 10 is a gasoline (petrol) engine and comprises an ignition device 16, such as a spark plug. In other embodiments a diesel engine (also known as a compression-ignition engine) may be employed, the ignition device 16 shown in FIG. 1 may be omitted and replaced with a glow-plug for heating the chambers of each cylinder 26 during starting. It is envisaged that the variable drive camshaft mechanism 18 may be employed with any spark ignition or compression ignition combustion engine.

Referring generally to FIGS. 1 to 7, construction and operation of the variable drive camshaft mechanism 18 will be described. The variable drive camshaft mechanism 18 comprises a four rollers 40 (see FIG. 2C, only two rollers 40 are shown for clarity); the rollers 40 are disposed about shaft 48; the rollers 40 are arranged so as to be equally spaced about the shaft 48 at 90 degree intervals. In alternative embodiments the variable drive camshaft mechanism 18 may comprise a greater or lesser number of rollers, in those embodiments having two or more rollers 40 it is envisaged that the rollers will be equally spaced about the shaft 48, for example two rollers will be disposed at 180 degree to one another, three rollers 40 would be disposed at 120 degree to one another. The first component 42 comprises a head 35 as shown in FIGS. 5A and 5B. The head 35 comprises an inner surface 36 against which the rollers 40 may be brought to bear. The sleeve 41 of second component 44 comprises a first end 47 (see FIGS. 6A to 6D). The first end 47 of the sleeve 41 is countersunk, that is to say it comprises a conical hole, so as to define a recess 53 in the walls of the sleeve 41 of the second component 44. The recess 53 is arranged to accommodate the rollers 40. The recess 53 comprises four channels or tracks 55, which each define an incline or ramp (see FIG. 6C). The rollers 40 are located within the tracks 55; the tracks 55 restrict the motion of the rollers 40 such that they may only move radially, inwardly or outwardly, guided by the tracks 55 and cannot move circumferentially about the recess 53. In other embodiments it is envisaged that the number of channels or tracks will be equal to the number of rollers 40.

In other embodiments the rollers 40 may be replaced with alternative actuators which act upon the head 36 of the first component 42 as a result of the centrifugal force experienced by the actuator in response to rotation of the variable drive camshaft mechanism 18; in one embodiment the rollers 40 may be replaced with spherical masses such as ball bearings.

Figures 6E, 6F, 6G:
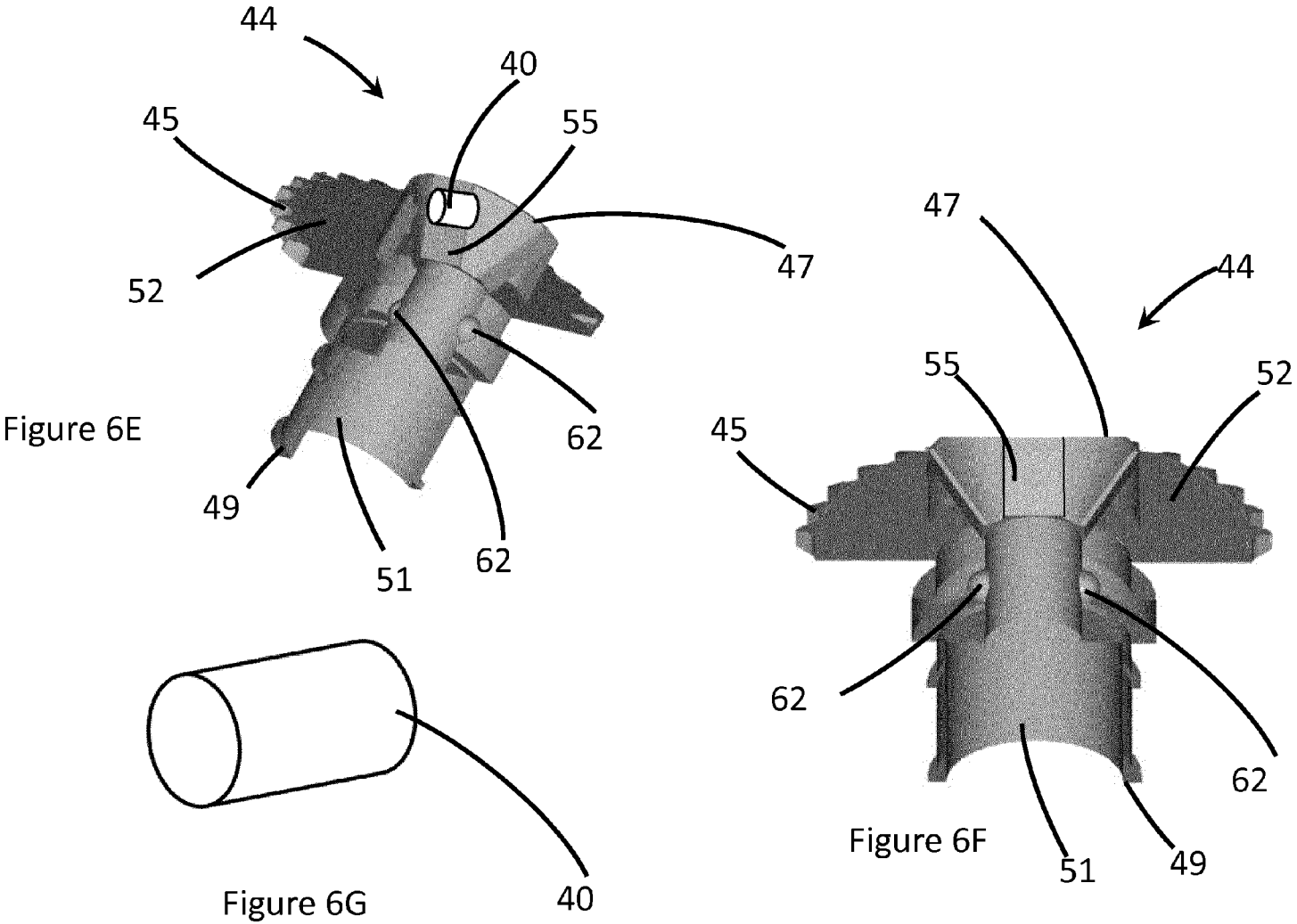
FIGS. 6E and 6F are further cut away perspective views of the second component of FIG. 6A.
FIG. 6G is perspective view of an actuator component or roller forming part of the variable camshaft drive mechanism according to an embodiment of the invention.
Figure 7:
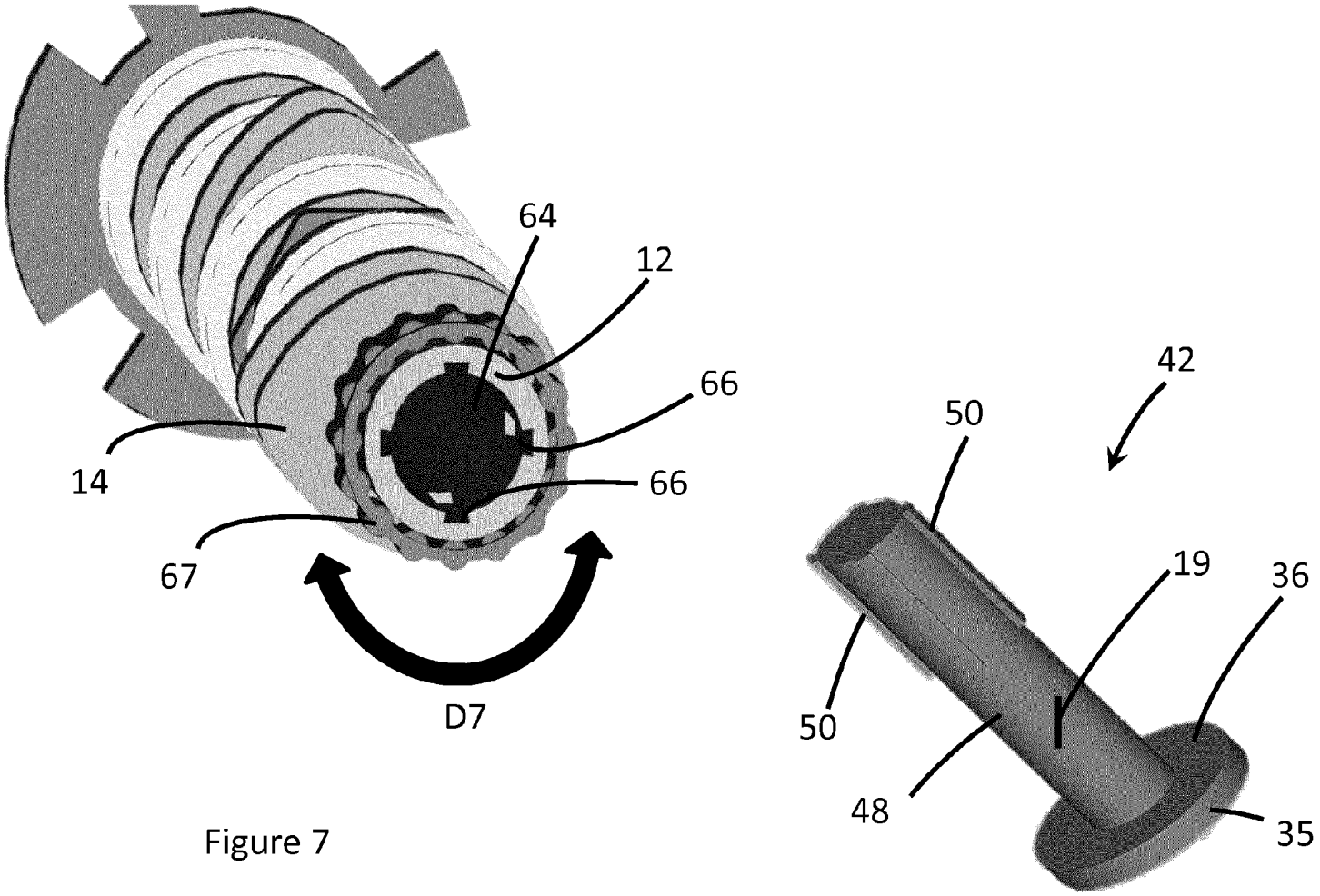
FIG. 7 is a perspective view of a camshaft and the first component according to an embodiment of the invention.

The walls of the sleeve 41 comprise a pair of pits 62 (see FIGS. 6E and 6F). Optionally the pits 62 are hemispherical in shape. The pits 62 are each arranged to receive an outer portion of a ball bearing 54 (see FIGS. 3A, 3B, 4A and 4B). The pits 62 are disposed internally of the sleeve 41, within the bore 51. The pits 62 retain the ball bearings 54 when the shaft 48 of the first component 42 is inserted into the bore 51 of the second component 44. The pits 62 are arranged to be disposed on opposing sides of the shaft 48. In alternative embodiments a greater or lesser number of pits 62, may be provided; the one or more pits 62 being arranged so as to be equidistant about the circumference of the bore 51.

The shaft 48 of the first component 42 comprises a pair of grooves 19 (see FIGS. 1, 4A, 4B, 5A, 5B and 7) disposed on the outer surface thereof. The grooves 19 are each arranged to receive a portion of a ball bearing 54 that is disposed more internally of the variable drive camshaft mechanism 18 than the pits 62. The arrangement of the pits 62, grooves 19 and ball bearings 54 couples the first component 42 to the second component 44, such that when the sprocket 52, and hence second component 44, is rotated by the timing belt or chain 20 the first component 42 is also caused to rotate. The ball bearings 54 transfer drive (rotational force) from the second component 44 to the first component 42. The ball bearings 54, pits 62 and groove 19 create a detent which causes the first component 42 to rotate when the second component 44 is driven rotationally.

In alternative embodiments other arrangements are envisaged, for example the pits 62 and ball bearing may be replaced with one or more protrusions or lugs extending radially inward from the inner surface of the bore 51 which one or more lugs engages with a respective groove 19. It will be appreciated that in other embodiments, the lugs may be provided on the first component 42 and the respective grooves 19 may be defined on the inner surface of the bore 51 of the second component 44. In other words the mechanism for transferring torque may be inverted.

Figure 5B:
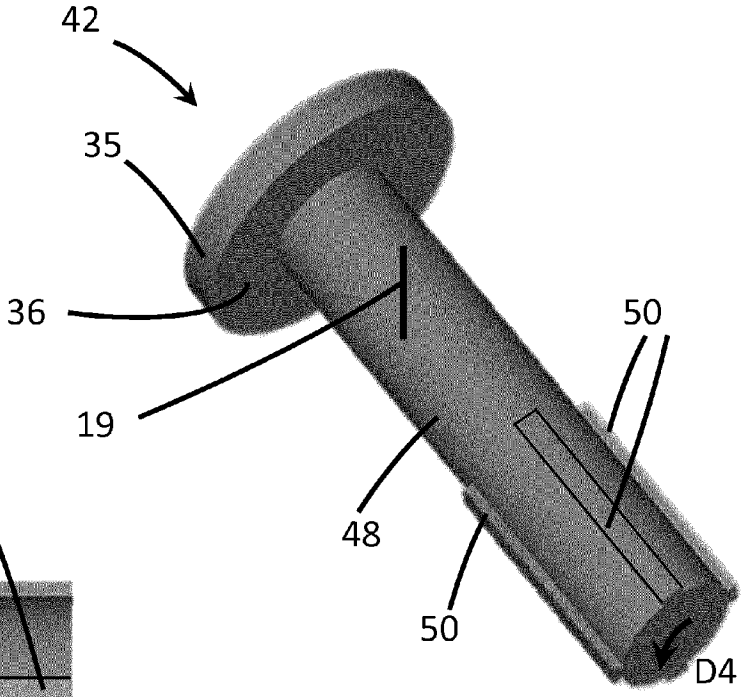
FIG. 5B is a perspective view of the first component of FIG. 5A.
Figure 5A:
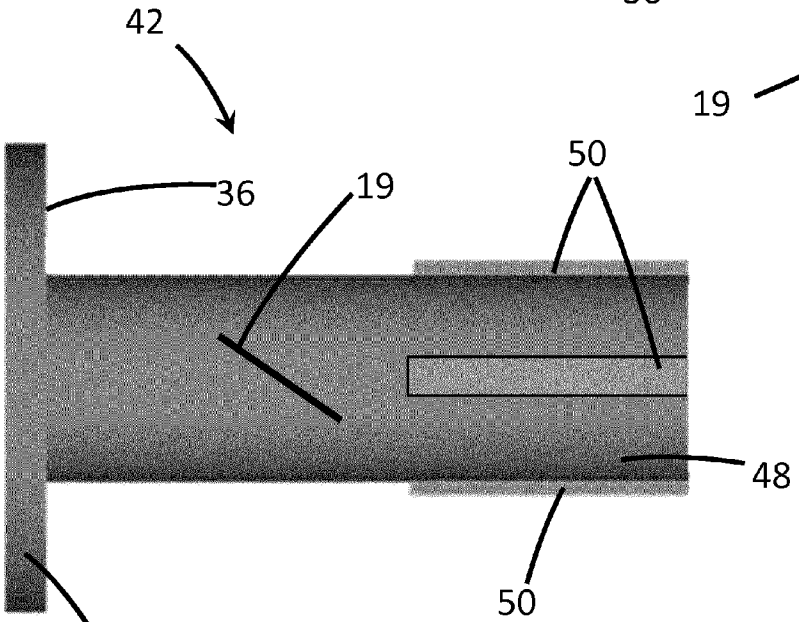
FIG. 5A is a side view of a first component forming the variable camshaft drive mechanism according to an embodiment of the invention.

The first component 42 comprises a spline which includes four ridges 50 on an outer surface of the shaft 48 (see FIG. 5A). The camshaft 12 comprises a bore or channel 64 defining an internal surface. The ridges 50 each mesh with a groove 66 on the internal surface of the camshaft 12 and transfer drive or rotational force to the camshaft 12 thereby maintaining the angular correspondence between the first component 42 and camshaft 12. In alternative embodiments a great or lesser number of ridges 50 and grooves 66 may be provided as desired. The camshaft 12 comprises a bearing 67 mounted thereon. The bearing 67 allows the camshaft 12 to rotate freely (as indicated by direction arrow D7 in FIG. 7), with respect to the second component 44. A second end 49 of the second component (shown in FIGS. 6E and 6F) is arranged to receive a portion of the camshaft 12.

When the engine 10 is operational the crank shaft 32 converts the linear motion of the pistons 28 into a rotatory motion. Rotational drive is provided to the first sprocket 22 by the crank shaft 32. The first sprocket 22 drives the chain 20 which in turn rotates the second component 44.

As the engine speed is increased, the number of revolutions per minute of the crank shaft 32 is increased, (this is achieved by increasing the charge (fuel/air mixture) injected into the cylinders 26) and the first sprocket 22 is rotated faster. This in turn leads to an increase in the rotational speed of the second sprocket 52. The variable drive camshaft mechanism 18 is therefore rotated faster. As the rotational speed increases, the rollers 40 move radially outwardly along the inclined ramps 55 defined in the second component 44, as shown by direction arrows D1 and D2 in FIG. 3B. The rollers 40 act upon the inner surface 36 of the head 35 of the first component 42. In doing so, the rollers 40 push the first component 42 in an axial direction as indicated by direction arrow D3. The radial outward movement of the rollers 40 can be considered to be as a consequence of a centrifugal force (or a centripetal force depending upon the frame of reference) acting upon the rollers 40.

When the rollers 40 push the first component 42 axially outward, the ball bearing 54 disposed in the groove 19 follows the groove 19. In the illustrated embodiment, the groove 19 is arranged to rotate the first component 42 in response to the rollers 40 pushing the first component 42 axially. The groove 19 is helically arranged to form a screw. The length of the groove 19 and the angular orientation (lead) of the groove 19 determine the angle through which the first component 42 is rotated with respect to the second component 44.

In this way, the variable drive camshaft mechanism 18 can rotate the camshaft 12 and hence the cams 14 such that the timing of the valves 24 can be advanced or retarded with respect to the piston cycle. Consequently, the valves 24 can be opened, or closed, sooner, or later, with respect to a predefined position of the piston in the cylinder, for example top dead centre or bottom dead centre.

The groove 19 comprises a first end C and a second end 0, when the ball bearing 54 is disposed at the first end C the first component 42 is arranged in a closed position with respect to the second component 44. When the ball bearing 54 is disposed at the second end C the first component 42 is arranged in an open position with respect to the second component 44. The first component 42 illustrated in FIGS. 5A and 5B rotates in a clockwise or anticlockwise direction relative to the second component 44 the direction of rotation will be dependent upon the direction of rotation of the crankshaft 32, as indicated by direction arrow D4. The ball bearing 54 is initially disposed at the second end C of the groove 19 which is disposed closest to the head 35. The rollers 40 are initially disposed in close proximity or contact with the shaft 48. As the speed of rotation of the variable drive camshaft mechanism 18 increases due to increase rotational speed of the crankshaft 32 the rollers 40 move radially outward, applying force to the head 35 in direction along the axis of the shaft 48 so as to move the first component axially until the ball bearing 54 reaches the second end of the groove 19.

Figure 8B:
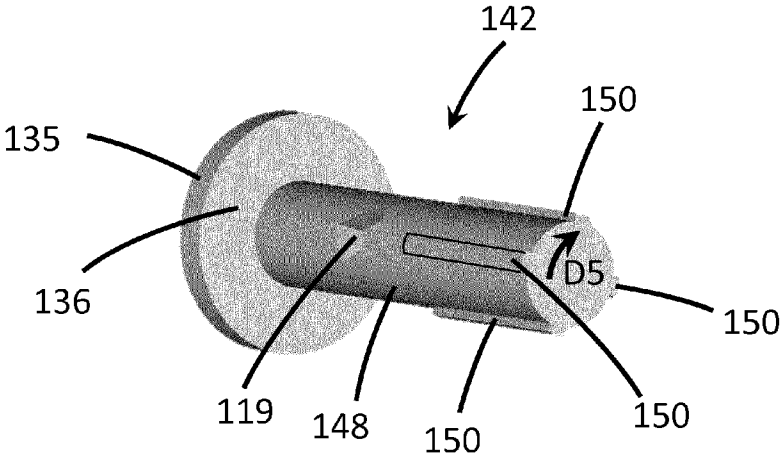
FIGS. 8A, 8B and 8C are perspective views of a component forming the variable camshaft drive according to another embodiment of the invention.
Figure 8C:
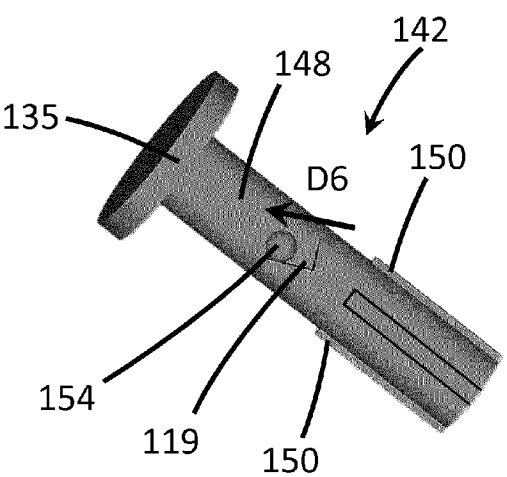
Figure 8A:
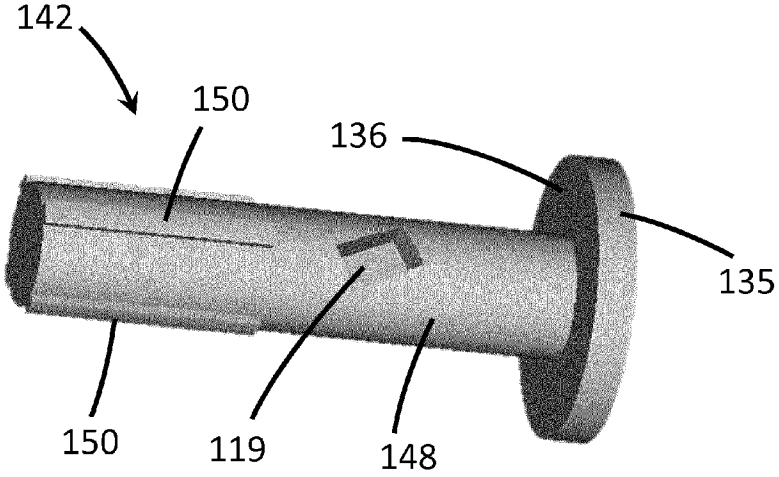

Referring now to FIGS. 8A, 8B and 8C there is shown an alternative embodiment of the variable drive camshaft mechanism 18 of the present invention. In this alternative illustrated embodiment, like numerals have, where possible, been used to denote like parts, albeit with the addition of the prefix "100" to indicate that these features belong to the alternative embodiment.

FIGS. 8A, 8B and 8C illustrate an alternative first component 142 in which the groove 119 has been orientated oppositely to that of FIGS. 5A and 5B. The alternative first component 142 may be employed with the second component 44 of FIG. 6A. The groove 119 is substantially shaped to be substantially arcuate in shape, optionally hemi-spherical, so as to accommodate the ball bearing 154 and of sufficient depth to receive a portion of the ball bearing 154. The ends of the groove 119 are arcuate or curved so as to be complementary to the ball bearing 154. The first component 142 illustrated in FIGS. 8A, 8B and 8C rotates in a clockwise or anticlockwise direction relative to the second component 44, dependent upon the direction of rotation of the crankshaft 32, as indicated by direction arrow D5. It will be appreciated that for a given direction of rotation of the crankshaft 32, the groove 119 of first component 142 of FIGS. 8A, 8B and 8C is arranged to effect a rotation of the first component 142 with respect to the second component 44 in an direction opposite to the direction for which the first component 42 of FIGS. 5A and 5B rotates with respect to the second component 44 for the same direction of rotation of the crankshaft 32. Again it is envisaged that the ball bearing 154 is initially disposed at the end of the groove 119 disposed closest to the head 135 and moves as indicated by direction arrow D6 to the opposing end of the groove 119 as shown in FIG. 8C. The spline 150 which couples the first component 142 to the camshaft (not shown) rotation of the first component 142 with respect to the second component effects a rotation of the camshaft this rotation of the camshaft can be employed to adjust the valve timing for example to advance or retard the valve timing with respect to the piston position.

Figure 11A:
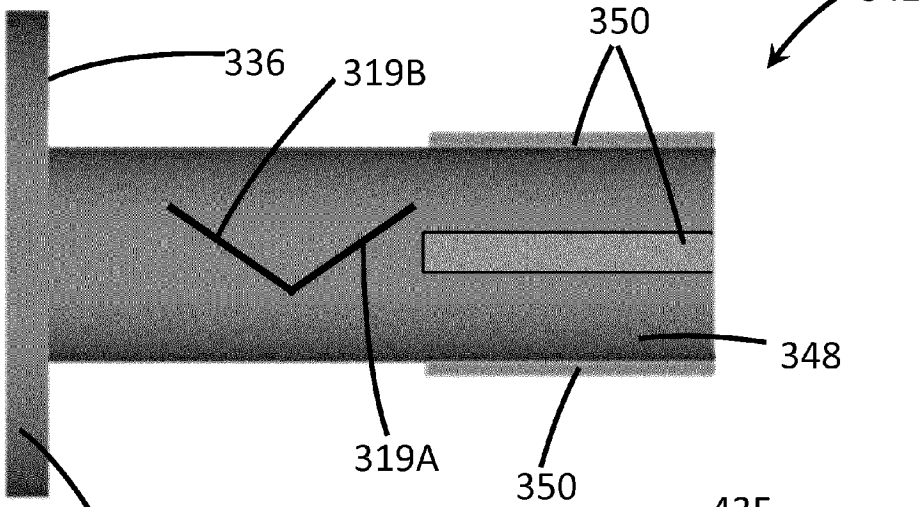
FIG. 11A is a side view of a first component forming the variable camshaft drive mechanism according to a still further embodiment of the invention.
Figure 11B:
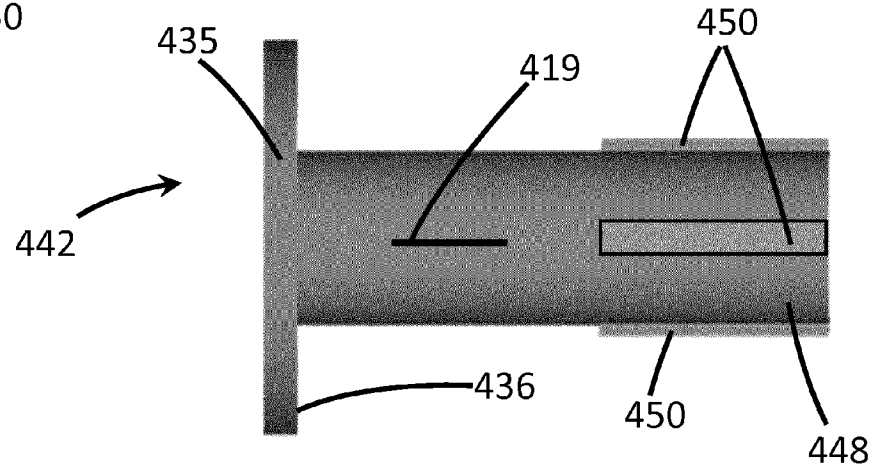
FIG. 11B is a side view of a first component forming the variable camshaft drive mechanism according to yet another embodiment of the invention.

Referring now to FIGS. 11A and 11B there are shown further alternative embodiments of the variable drive camshaft mechanism 18 of the present invention. In these further alternative illustrated embodiments, like numerals have, where possible, been used to denote like parts, albeit with the addition of the prefix "300" or "400" to indicate that these features belong to the further alternative embodiments respectively.

FIG. 11A illustrates a first component 342 in which the groove 319A/319B comprises a first portion 319A which effects a rotation of the first component 342 in a first direction. The groove 319A/319B comprises a second portion 319B which effects a rotation of the first component 342 in a second direction opposite to the first direction. In this way when the rollers (not shown) push against the head 335 the first component 342 initially rotates in the first direction. As the rollers 40 continue to push against the head 335, the ball bearing 54 follows the second portion 319B and rotates the first component 342 in the second direction. It will be appreciated that first and second portions 319A, 319B are arranged to bring the first component 342, and hence camshaft 12, back to its starting position when the ball bearing 54 reaches the end of the second portion 319B. However, in alternative embodiments, the end stop of the second portion 319B may be arranged differently. It will also be appreciated that whilst in the illustrated embodiment the groove 319A/319B is symmetrical in other embodiments it may be arranged differently the first portion 319A may be longer or shorter in length than the second portion 319B; the angular orientation (lead) of the first portion 319A may be different to that of the second portion 319B.

FIG. 11B illustrates a first component 442 in which the groove 419 is substantially parallel to a longitudinal axis of the shaft 448. In this embodiment when the rollers push against the head 435 the first component 442 is moved axially, there is no rotation relative to the second component (not shown). First component 442 may be coupled to a camshaft (not shown) in which the profile or shape of the, or each, cam changes in an axial direction. In this way, when the rollers (not shown) push against the head 435, the variable drive camshaft mechanism allows the axial position on the cam which the valve stem (or push rod or other cam follower) makes contact with the cam to be changed. The cam profile may vary along it axial length such that a different profile of the cam may be used to lift the valve the portion of the cam and hence profile being employed being dependent upon the engine speed.

Figure 9:
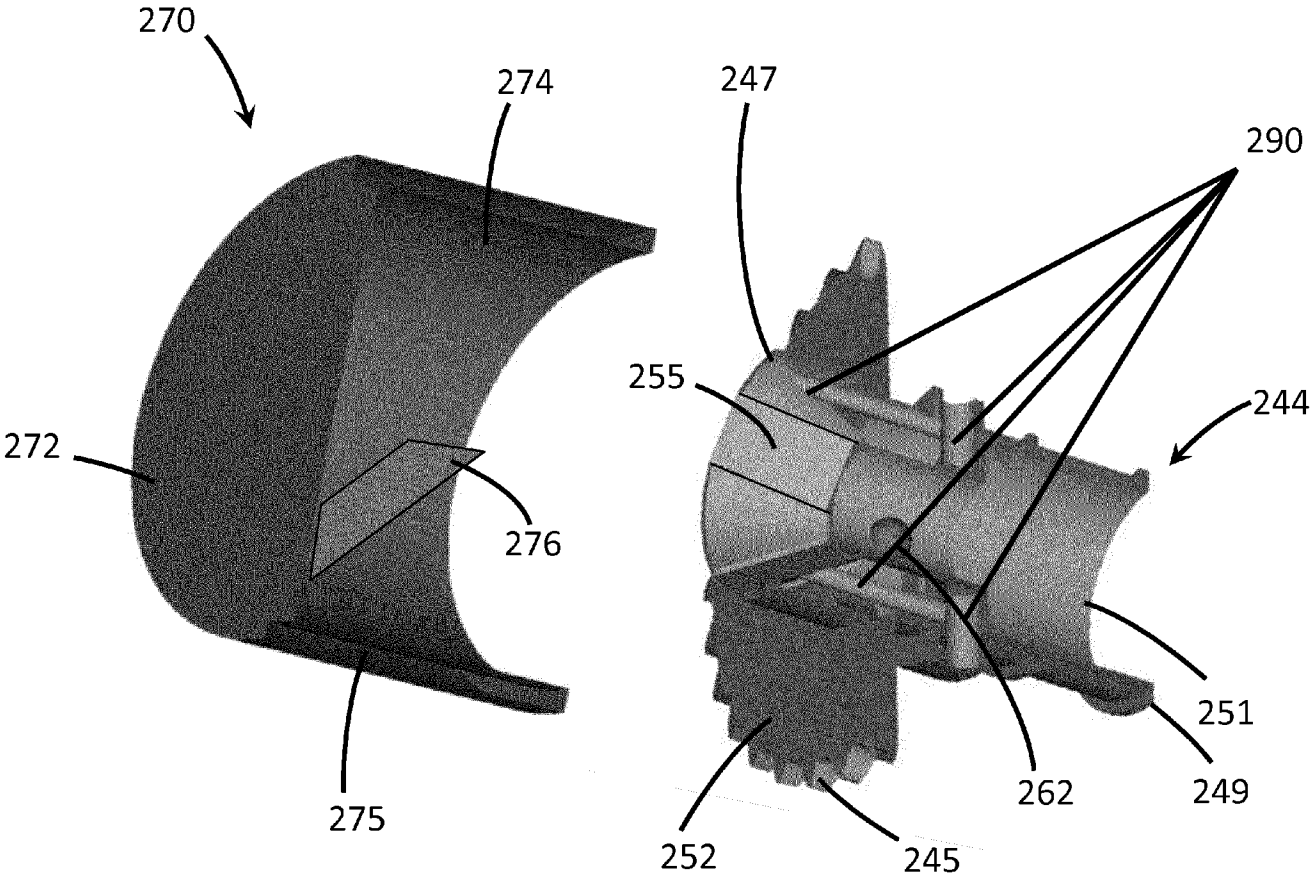
FIG. 9 is a cut away exploded perspective view of components for forming a variable camshaft drive mechanism according to a further embodiment of the invention.
Figure 10:
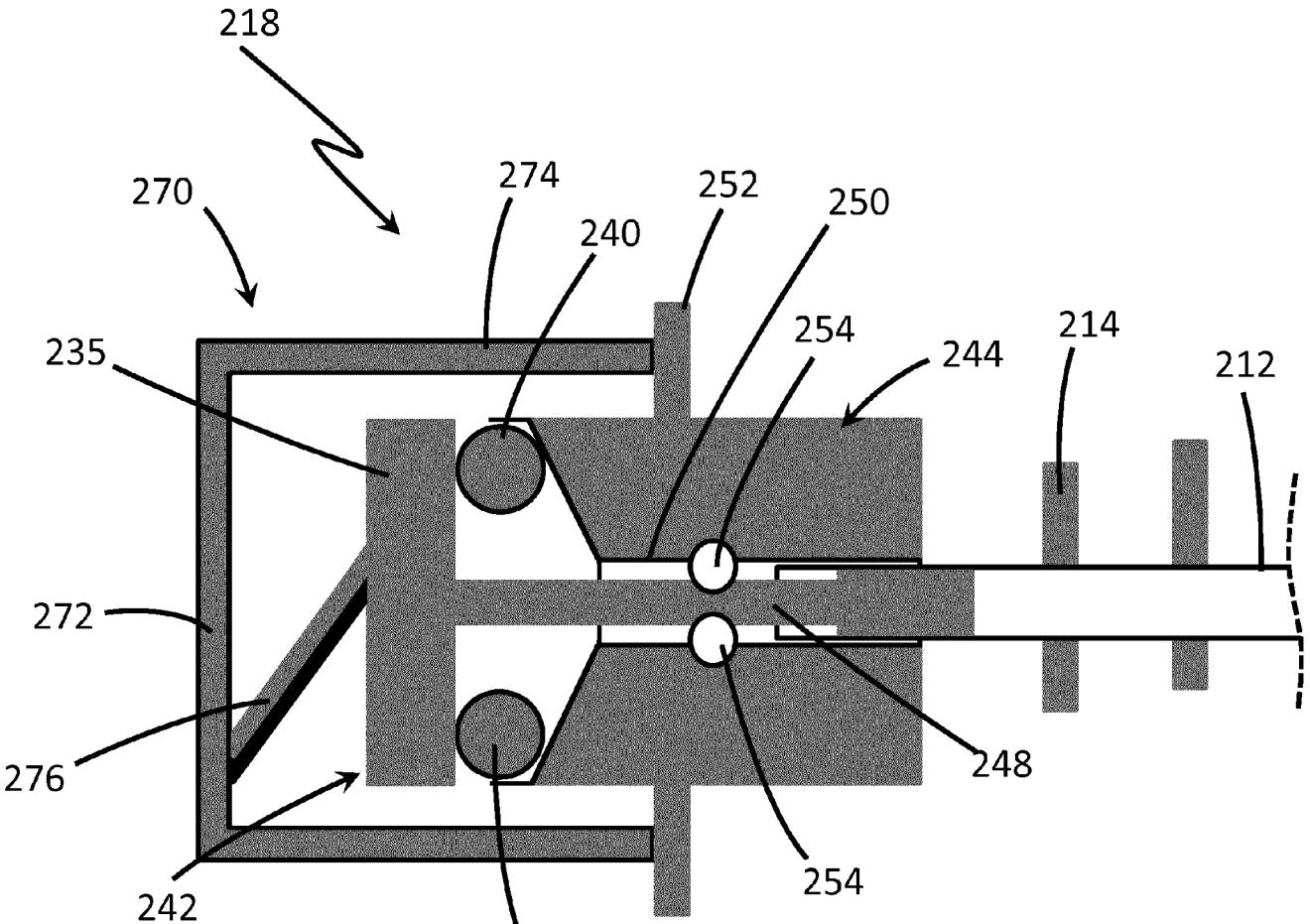
FIG. 10 is a cross-sectional view of the variable camshaft drive mechanism and a portion of the camshaft according to the further embodiment of the invention.

Referring now to FIGS. 9 and 10, there is shown a still further alternative embodiment of the variable drive camshaft mechanism of the present invention. In this illustrated embodiment, like numerals have, where possible, been used to denote like parts, albeit with the addition of the prefix "200" to indicate that these features belong to the still further alternative embodiment.

FIGS. 9 and 10 show a variable camshaft drive mechanism 218 in which an end cap 270 is provided. End cap 270, along with the second sprocket 252, encloses the head 235 of the first component 242 and the first end 247 of the second component 244. The end cap restricts the movement of the first component 242 with respect to the second component 244 preventing the first component 242 from being separated from the second component 244 and retaining the rollers 240 therebetween. The end cap prevents or reduces the ingress of dirt or other foreign objects into the variable camshaft drive mechanism 218. The end cap 270 comprises an end wall 272 and side walls 275, the end cap 270 is a cylindrical tube closed at one end by the end wall 272. The end cap 270 provides a chamber 274 in which lubricant (not shown) such as oil can be retained. The end cap 270 comprises a resilient biasing means in the form of a bi-metallic spring 276. A first end of the bi-metallic spring 276 is mounted to the interior of the end cap 270. A second end is in contact with the head 235 of the first component 242. The bi-metallic spring 276 biases the first component 242 so as to encourage the shaft 248 into the bore 250 of the second component 244. The bi-metallic spring 276 encourages the rollers 240 radially inwards towards the shaft 248 of the first component 242.

In order for the shaft 248 of the first component 242 to withdraw from the bore 250 of the second component 244, the rollers 240 must apply sufficient force to the head to overcome the bias of the bi-metallic spring 276 in addition to any other forces, such as, but not limited, to frictional forces.

The second component 244 comprises a plurality of channels 290 which allow engine oil to enter the chamber formed by the end cap 270. The engine oil transfers heat to the bi-metallic spring 276. Heat from the engine oil is transferred to each of the metals forming the bi-metallic spring 276 at different rates and causes them to expand by different amounts thereby changing the shape of the bi-metallic spring 276 and the force applied by it.

In one application it is envisaged that when the engine starts up and is cold the timing of the camshaft 212, and hence the valves (not shown), may be advanced or retarded with respect to piston position to optimise engine performance or emissions. As the engine warms up the bi-metallic spring 276 will exert sufficient force upon the first component 242, overcoming the force from the rollers 240 to rotate the first component 242 and camshaft 212 to operate the cams 214 and hence the valves with a different timing with respect to the piston position, and thereby optimise engine performance or emissions.

It can be appreciated that various changes may be made within the scope of the present invention, for example, in other embodiments of the invention it is envisaged that in embodiments having a first camshaft actuating the inlet valves and a second camshaft actuating the outlet valves each camshaft can be provided with a variable drive camshaft mechanism 18 such that the degree of overlap, when the inlet and outlet valves are open at the same time can be varied with engine speed.

It is envisaged that the variable camshaft drive mechanism may comprise a spring return mechanism or other suitable biasing means which acts upon the rollers to return them to their start position adjacent the shaft of the first component, it will be appreciated that in order to move radially outward the rollers would need to overcome the bias of spring return mechanism, and that the variable camshaft drive mechanism may be tuned to operate at a specific predetermined rotational speed dependent upon the biasing force exerted by the spring return mechanism which needs to be overcome.

Whilst the foregoing embodiments describe a linear ramp it is envisaged that the rolling surface, provided by the second component, upon which the roller are in contact may have any desired profile, which may be non-linear, such that the amount of axial movement of the first component for a given amount of radial movement of the roller is not constant but rather varies over the radial travel of the roller.

Furthermore, in other embodiments the specific form and number of rollers 40 may vary.

Optionally, the rollers 40 are cylindrical and smooth and optionally at least two rollers 40 are used. However, in other embodiments one or more rolling members that are configured to travel toward the head and force the head of the first component axially outward may be used. The rollers need not be restricted to radially movement by the channels 55 but may be arranged to follow a spiral path, the rollers may be tapered in shape to facilitate such spiral movement. The diameter of the rollers may vary long their axial length; such variations in diameter may be stepwise or continuous. It is envisaged that the channels 55 will be shaped complementarily to the rollers 40.

The groves 19, 119, 319, 319B are described as being disposed on the outer surface of the first component 42. The term "groove" refers to all manner of formations which facilitate the guided movement of a ball bearing or other follower, such that with increasing or decreasing acceleration of the rollers/rolling means, movement of the second component can be adjusted or modified with respect to the movement of the first component. However any reference to groove should not be construed as necessarily referring to a single groove only, indeed as depicted in FIG. 11A the groove may comprise two or more portions each angled with respect to another portion. Furthermore any reference to groove should not be construed as being a straight-edged groove.

It should be understood that because the groove has a depth, the phrase "disposed on the outer surface of the first component" is intended to include grooves formed within the material forming the outer-side of the first component.

Whilst the foregoing embodiments have been described in reference to a combustion engine have an overhead camshaft; is envisaged that in alternative embodiments the combustion engine may have an alternative configuration such as but not limited to cam in block configurations for example, overhead valve (push rod) configuration or side valve configuration.

The invention claimed is:

1. A device for effecting an axial shift of a rotary shaft comprising:

a first component having a shaft and a head;

a second component having a first end and a second end and a bore extending longitudinally therethrough, the first end of the second component being countersunk so as to define inclined ramps in walls as a portion of the second component;

the shaft of the first component being inserted into the bore of the second component;

a detent for coupling the first component to the second component such that rotation of the second component causes the first component to rotate;

one or more rollers disposed in between the head of the first component and the first end of the second component in rolling contact with the inclined ramps;

the device being configured such that as the second component is rotated about a longitudinal axis the rollers move along the inclined ramps and act upon the first component to move it axially with respect to the second component; and wherein the detent comprises a groove and a bearing seated therein, the groove arranged to effect a rotation of the first component with respect to the second component as the first component is moved axially with respect to the second component.

2. A device according to claim 1 wherein the groove is arranged parallel to a longitudinal axis of the shaft of the first component so as to restrict movement of the first component to be axially within the bore of the second component.

3. A device according to claim 1 comprising a resilient biasing device biased against the first component to resist axial movement of the first component with respect to the second component.

4. A device according to claim 3 wherein the resilience of the resilient biasing device is dependent upon temperature.

5. A device according to claim 4 wherein the resilient biasing device comprises a bi-metallic spring disposed in thermal contact with a reservoir of liquid and wherein in response to a change in the temperature of the liquid in the reservoir, the resilience of the bi-metallic spring changes and thereby the device can be de-activated by the resilient biasing device at certain temperatures.

6. A device according to claim 1 wherein the inclined ramps comprise one or more tracks defined in and extending radially across the walls of the second component, each track being configured to receive a portion of one of the rollers to restrict movement of the roller such that the roller cannot move circumferentially.

7. A device according to claim 1 wherein the first component comprises a spline for coupling to a camshaft to effect rotation thereof.

8. A vehicle comprising the device of claim 1.

9. A variable drive mechanism for a camshaft comprising:

a first component having a shaft and a head, the shaft comprising a spline for coupling the first component to a camshaft;

a second component having a first end and a second end and a bore extending longitudinally therethrough for receiving the shaft of the first component, the second component comprising a sprocket for being coupled to a crankshaft to effect rotation of the second component;

a detent for coupling the first component to the second component such that rotation of the second component causes the first component to rotate;

one or more actuators disposed in between the head of the first component and the first end of the second component;

wherein in response to rotation of the second component, about a longitudinal axis, a centrifugal or centripetal force causes the one or more actuators to act upon the head of the first component to move it axially with respect to the second component; and wherein the detent comprises a groove and a bearing seated therein, the groove arranged to effect a rotation of the first component, with respect to the second component, as the first component is moved axially with respect to the second component.

10. A variable drive mechanism according to claim 9, wherein the first end of the second component is countersunk so as to define inclined ramps in walls of the second component and the one or more actuators comprise one or more rollers disposed in between the head of the first component and the first end of the second component in rolling contact with the inclined ramps.

11. A variable drive mechanism according to claim 10, wherein the inclined ramps comprise one or more tracks defined in and extending radially across the walls of the second component, each track being configured to receive a portion of the one or more rollers to restrict movement of the roller such that the roller cannot move circumferentially.

12. A variable drive mechanism according to claim 9, wherein the groove is arranged parallel to a longitudinal axis of the shaft of the first component so as to restrict movement of the first component to be axially within the bore of the second component.

13. A variable drive mechanism according to claim 9, comprising a resilient biasing device biased against the first component to resist the axial movement of the first component with respect to the second component.

14. A variable drive mechanism according to claim 13, wherein the resilience of the resilient biasing device is dependent upon temperature.

15. A variable drive mechanism according to claim 14, wherein the resilient biasing device comprises a bi-metallic spring disposed in thermal contact with a reservoir of liquid and wherein in response to a change in the temperature of the liquid in the reservoir, the resilience of the bi-metallic spring changes and thereby the mechanism can be de-activated by the resilient biasing device at certain temperatures.

16. A vehicle comprising the variable drive mechanism of claim 9.

17. An engine for a vehicle comprising:

one or more cylinders;

the or each cylinder comprising a piston slideably mounted therein;

the or each piston being coupled to a crankshaft by a connecting rod;

a first sprocket mounted upon the crankshaft;

the or each cylinder comprising one or more openings;

the or each opening comprising a valve for closing the opening;

a camshaft comprising one or more cams for actuating a respective valve;

a variable drive mechanism coupled to the camshaft;

the variable drive mechanism comprising:

a first component having a shaft and a head, the shaft comprising a spline coupling the first component to the camshaft;

a second component having a first end and a second end and a bore extending longitudinally therethrough in which the shaft of the first component is mounted, the second component comprising a second sprocket coupled to the first sprocket such that rotation of the crankshaft effects rotation of the second component;

a detent coupling the first component to the second component such that rotation of the second component causes the first component to rotate;

one or more actuators disposed in between the head of the first component and the first end of the second component;

the engine being configured such that in response to rotation of the second component, about a longitudinal axis, a centrifugal or centripetal force causes the one or more actuators to act upon the head of the first component to move the first component axially with respect to the second component thereby changing a control parameter of the operation of the or each valve; and wherein the detent comprises a groove and a bearing seated therein, the groove arranged to effect a rotation of the first component with respect to the second component as the first component is moved axially with respect to the second component so as to advance or retard the opening or closing of the or each valve with respect to a predefined position of a respective piston within its respective cylinder.

18. An engine according to claim 17, wherein each cylinder comprises at least two openings each having a valve, wherein at least one valve is an inlet valve for allowing insertion of charge into the cylinder, and at least one valve is an outlet valve for allowing egress of exhaust gases, the engine comprising a first camshaft having at least one cam for actuating a respective one of the at least one inlet valves and a second cam shaft having at least one cam for actuating a respective one of the at least one outlet valves, each camshaft comprising a variable drive mechanism coupled thereto, wherein each variable drive mechanism can advance or retard the opening or closing of the or each of the respective valves to which it is coupled with respect to a predefined position of a respective piston within its respective cylinder, in this way the period or time when both the inlet valves and the outlet valves are open or closed simultaneously can be controlled dependent upon rotational speed of the crankshaft.

19. An engine according to claim 17, wherein at least one valve mounted upon the camshaft comprises a profile which changes in an axial direction such that an axial movement of the camshaft effects a change in the cam profile with a change in the rotational speed of the crankshaft.

20. A vehicle comprising the engine of claim 17.

* * * * *